United States Patent [19]

Higuchi et al.

[11] Patent Number: 4,531,647

[45] Date of Patent: Jul. 30, 1985

[54] DEVICE FOR STOPPING THE SWINGING MOVEMENT OF A LOAD HUNG BY A CRANE

[75] Inventors: Masao Higuchi; Shuzo Uno, both of Kudamatsu; Yasuhisa Ishii, Hikari; Kazuhiro Makino; Kenichi Okasaka, both of Kudamatsu, all of Japan

[73] Assignee: Hitachi, Ltd., Tokyo, Japan

[21] Appl. No.: 755,804

[22] Filed: Dec. 30, 1976

[30] Foreign Application Priority Data

Jan. 14, 1976 [JP] Japan ..... 51-2796
May 12, 1976 [JP] Japan ..... 51-53672

[51] Int. Cl.[3] ..... B66C 17/00

[52] U.S. Cl. ..... 212/147; 212/158; 212/205

[58] Field of Search ..... 212/146, 147, 148, 125, 212/126, 205, 221, 157, 158; 414/626; 294/81 SF, 67 BA; 105/148, 149, 163 R; 104/89; 188/318, 319

[56] References Cited

U.S. PATENT DOCUMENTS

| | | | |
|---|---|---|---|
| 1,484,193 | 2/1924 | Scott | 188/319 |
| 2,646,273 | 7/1953 | Wetsel | 212/158 |
| 3,603,612 | 9/1971 | Hill | 188/318 X |
| 3,653,518 | 4/1972 | Polen | 294/81 SF |
| 3,746,182 | 7/1973 | Tax et al. | 212/125 |
| 3,883,859 | 5/1975 | Ancheta | 212/157 |
| 3,887,081 | 6/1975 | Gill | 212/128 |
| 3,899,083 | 8/1975 | Flessner et al. | 212/125 X |
| 4,067,460 | 1/1978 | Schwarz | 212/125 X |

*Primary Examiner*—Sherman D. Basinger
*Attorney, Agent, or Firm*—Antonelli, Terry & Wands

[57] ABSTRACT

A device for stopping the swinging movement of a load hung by a crane. The crane includes a trolley mounted on an overhead girder of the crane with the trolley being capable of traveling back and forth on the overhead girder. A beam is pivotally supported by the trolley with two sets of sheaves mounted on the beam for displacement relative to each other. Ropes are trained over the two sets of sheaves. A suspension member is provided for suspending the load to be moved by the crane with the suspension member being connected to the lower ends of the ropes. Dampers are mounted between the trolley and the beam. The energy of the swinging movement of the load is converted, through the sheaves to the energy of the oscillating movement of the beam which is transmitted to the dampers, so that the energy causing the load to move in swinging motion can be absorbed by the dampers with a high degree of efficiency and the swinging movement of the load can be quickly stopped.

26 Claims, 8 Drawing Figures

DEVICE FOR STOPPING THE SWINGING MOVEMENT OF A LOAD HUNG BY A CRANE

This invention relates to a device for stopping the swinging movement of a load or cargo adapted for use with a crane of the type in which the cargo is lifted by means of the crane through ropes and moved from one place to another to load or unload the cargo.

One problem commonly encountered with respect to a crane of the type in which a load or cargo is lifted by means of a trolley through ropes and moved from one place to another in that the cargo moves in pendulum motion when the trolley stops at the destination. If the cargo hung from ropes moves in pendulum motion, difficulty will naturally be experienced in lowering the cargo and accurately putting the same down in a predetermined position. Thus this type of crane has the disadvantage of reduced efficiency with which a loading or unloading operation is performed. There has been a demand for effective means for obviating this disadvantage.

In order to obviate this disadvantage, various proposals have hitherto been made to provide the crane with a device for suppressing the pendulum motion of a cargo lifted and moved by the crane of the type described.

In one type of swinging movement stopping device generally known in the art, a rope is obliquely trained between the trolley and the cargo hung thereby so that the rope may develop a horizontal component of force which is effective to offer resistance to the pendulum motion of the cargo. However, some disadvantages are associated with this type of device. For one thing, the angle of inclination imparted to the rope is restricted by the size of the trolley, and it is impossible to provide a horizontal component force of high magnitude. Moreover, as the rope repeatedly expands and contracts, the rope performs a spring action. Because of these defects, this known device has little effect in damping the pendulum motion of the cargo.

The prior art capable of increasing the effect of damping the pendulum motion of the cargo which is most closely related to the present invention is disclosed in U.S. Pat. No. 3,746,182. The device of this prior art comprises a pair of rope winding drums mounted on the trolley of the crane in a manner to be disposed symmetrically on left and right ends of the trolley, ropes paid out of the rope winding drums and trained over the sheaves on a spreader in such a manner that the ropes run symmetrically at left and right sides, a balance beam mounted on the trolley for tilting motion so that one end of each of the ropes to be wound is secured to each of the tilting ends of the balance beam in a manner to be symmetrical at left and right sides, and dash pots each mounted between one of the tilting ends of the balance beam and the trolley.

In the swinging movement stopping device constructed as aforesaid, when the spreader moves in swinging motion, the energy of the swinging motion manifests itself as the difference in rope tension between the ropes which are symmetrically disposed at the left and right sides, thereby tilting the balance beam. The force for tilting the balance beam is transmitted to one of the dash pots and damped thereby. As a result, the energy of the swinging motion is absorbed by the dash pot, and the swinging of the spreader is forcedly stopped.

In the prior art device constructed as aforementioned, the ropes to be wound are each connected only at one end thereof to the balance beam. Thus the efficiency with which the energy of the swinging motion is transmitted to the dash pot is low. Because of this, the prior art device has a disadvantage in that it takes a long time for the swining movement to come to a stop.

Also, since the sheaves on the spreader move along the ropes in rolling motion when attempts are made to stop the swinging movement, the efficiency ith which the energy of the swinging movement is transmitted to the dash pot is further reduced, thereby causing an increase in the time required for stopping the swinging movement.

This invention has as its object the provision of an improved device for stopping the swinging movement of a load or cargo which is capable of damping in a short duration of time the pendulum movement of the cargo hung by a trolley from ropes.

According to the invention, there is provided a device for stopping the swinging movement of a load hung by a crane, comprising a trolley mounted on an overhead girder of the crane and capable of traveling back and forth thereon, a pivotal member pivotally supported by the trolley, a pair of sheave means mounted on the pivotal member, ropes trained over the pair of sheave means and depending therefrom respectively, a suspension member connected to the lower ends of the ropes, and damping means located between the trolley and the pivotal member for damping the pivotal movement of the pivotal member.

The device constructed as aforementioned in accordance with the invention, preferably further comprises a pair of carriages on which the pair of sheave means are mounted, respectively and means for moving the two carriages toward and away from each other to adjust the distance between the two carriages.

FIG. 2 is damped, in comparison with the damping of the pendulum movement of a cargo by devices of the prior art;

Figure 1:
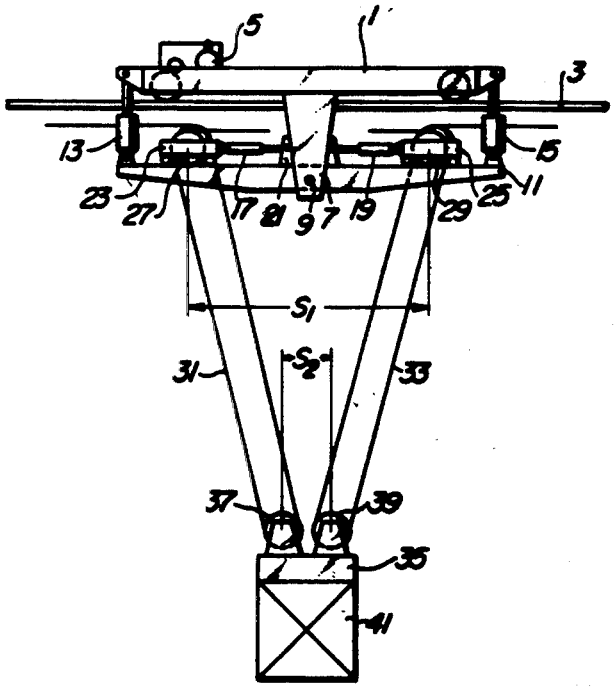
FIG. 1 is a fragmentary schematic view of the trolley portion of a container crane in which this invention is incorporated, showing the cargo in a stationary condition.

In FIG. 1, there is shown a trolley 1 of a container crane which is adapted to be driven by drive means 5 mounted on the trolley 1 to travel along rails 3 located on an overhead girder of the container crane. The trolley 1 has attached thereto a bracket 7 which supports at its lower end portion, through a pin 9, a beam 11 in its center, so that the beam 11 is pivotally movable about the pin 9. Oil dampers 15 and 13 are mounted between opposite ends of the beam 11 and opposite ends of the trolley 1 and function to suppress the pivotal movement of the beam 11.

The beam 11 has attached to its central portion a bracket 21 which has piston rods of piston-cylinder assemblies 17 and 19 connected to opposite end portions thereof through pins so that the piston-cylinder assemblies 17 and 19 extend parallel to the beam 11 and in opposite directions relative to the bracket 21. The cylinders of the piston-cylinder assemblies 17 and 19 are mounted on carriage 23 and 25 respectively on the beam 11. The carriages 23 and 25 are adapted to move on the beam 11 as the piston-cylinder assemblies 17 and 19 are actuated such that the pistons are withdrawn into or extend from the cylinders. The carriage 23 mounts thereon one of a pair of sheave means generally designated by reference numeral 27, while the carriage 25 mounts thereon the other of the pair of sheave means generally designated by the reference numeral 29. Each of the pair of sheave means 27 and 29 includes two sheaves 27*a*, 27*b* and 29*a*, 29*b*. The pair of sheave means 27 and 29 can swing about the pin 9 as the beam 11 moves in pivotal motion about the pin 9.

A spreader 35, which is a suspension member of the container crane, can be brought into engagement with a container 41 and has mounted on its upper surface sheaves 37 and 39 arranged such that they have a center distance $S_2$. Ropes 31 and 33 for supporting the spreader 35 extend along the overhead girder of the container crane and pass through the trolley 1 in reaching the spreader 35. More specifically, the rope 33 is trained over one of the sheaves 29*b* and runs downwardly to be trained over the sheave 39 on the spreader 35; then it runs upwardly and is trained over the other of the sheaves 29*a*. The rope 31 is trained over one of the sheaves 27*a* and runs downwardly to be trained over the sheave 37 on the spreader 35; then it runs upwardly and is trained over the other of the sheaves 27*b*.

The sheave means 27 and 29 are arranged such that they have a center distance $S_1$ which is greater than the center distance $S_2$ of the sheaves 37 and 39 on the spreader 35.

Figure 2:
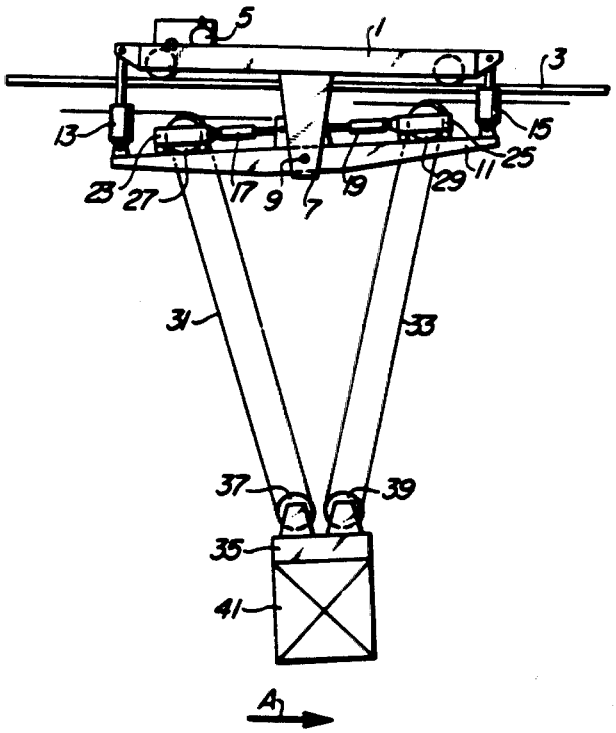
FIG. 2 is a view similar to FIG. 1 but showing the cargo moving in pendulum motion.

In the mechanism constructed as aforementioned, let us assume that the trolley 1 traveling in the direction of an arrow A stops its movement as shown in FIG. 2. If this occurs, the spreader 35 and container 41 will keep moving in the direction of the arrow A and then they will begin swinging in pendulum motion due to inertia. When the spreader 35 and container 41 swinging in the direction of the arrow A, the rope 31 will increase in tension while the rope 33 will decrease in tension, and the beam 11 will move counterclockwise in pivotal motion about the pin 9. Consequently the sheave means 27 and 29 will move about the pin 9.

The beam 11 moving counterclockwise in pivotal motion will cause the oil damper 13 to expand and the oil damper 15 to contract. When the oil damper 13 expands and the oil damper 15 contracts, the force which causes the beam 11 to move in pivotal motion is absorbed by the dampers 13 and 15. In this way, the energy of the pendulum movement of the spreader 35 and the container 41 is absorbed by the oil damper 13 and 15, with the result that the pendulum movement thereof is damped quickly. When this swinging movement is stopped, the sheave means 27 and 29 move about the pin 9 in accordance with the pendulum movement of the spreader 35 and container 41. Because of this, the ropes 31 and 33 are not subjected to an unduly high tension. This keeps the ropes 31 and 33 from expanding or contracting too greatly, so that the ropes 31, 33 do not perform a spring action. This is conducive to quick cessation of the pendulum motion.

After the swinging movement of the spreader 35 and container 41 in the direction of the arrow A has reached a maximum level, they move in an opposite direction toward the stationary position shown in FIG. 1. During this process, the beam 11 moves clockwise in pivotal motion about the pin 9, and the force which causes the beam 11 in pivotal motion is absorbed by the oil dampers 13 and 15, thereby decreasing the energy of the pendulum movement of the spreader 35 and container 41. This results in a great reduction in the amplitude of the pendulum movement of the spreader 35 and container 41 in a short period of time. Thus, after the trolley 1 has come to a halt, the pendulum movement of the spreader 35 and container 41 comes to an end in a short period of time.

In the mechanism for stopping the pendulum movement as described above, the sheaves 37 and 39 do not move in rolling motion over the ropes 31 and 33 during a damping of the swinging movement. Thus the energy of the swinging movement is converted to the tension of the ropes 31 and 33 in early stages and transmitted to the oil dampers 13 and 15 through the beam 11, thereby advancing the time of initiation of the cessation of the swinging movement and shortening the duration of time in which the swinging movement takes place.

Figure 3:
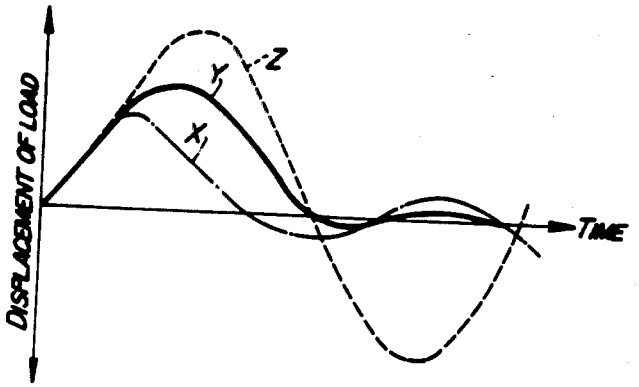
FIG. 3 is a graph showing the manner in which the pendulum movement of the cargo hung by the crane embodying the invention as shown in FIG. 1

FIG. 3 shows the results of experiments conducted on stopping of the swinging motion. In the graph, the time elapsed is set forth along the horizontal axis and the horizontal displacement of the bottom of the container 41 relative to the trolley along the vertical axis. In the figure, curves X and Z represent the swinging movements of loads which took place when swinging movement stopping devices of the prior art described hereinabove were used. These curves show that the devices of the prior art have little effect in stopping the swinging movement of the loads and reduce the efficiency with which loading or unloading is performed by the container crane. The swinging movement of the load when the device according to the present invention is used with a container crane is such that it can be indicated by a curbe Y which shows that the swinging movement can be damped effectively in a short period of time.

What is particularly noteworthy in regard to the present invention is that, when cargoes are moved through a narrow hatchway of a ship into its hold for loading or out of its hold for unloading, the spacing between the ropes 31 and 33 can be reduced if the carriages 23 and 25 are moved toward each other by withdrawing the piston rods of the piston-cylinder assemblies 17 and 19 into the respective cylinders. This enables loading or unloading to be performed safely without the ropes 31 and 33 coming into contact with the edge of the hatchway.

Also, if the piston-cylinder assemblies 17 and 19 are actuated to move the carriages 23 and 25 and adjust the ropes 31 and 33 such that the point of intersection of the extensions of the ropes 31 and 33 draws nearer to the center of gravity of the container projected perpendicularly onto a plane extending through the ropes 31, 33, the moment tending to cause the container 41 to be displaced can be minimized. Thus it is possible to prevent the swinging of the container about its center of gravity.

Moreover, if the piston-cylinder assemblies 17 and 19 are actuated to vary the positions of the carriages 23 and 25 in accordance with the weight of the container 41, it is possible to set at a suitable level the force exerted on the oil dampers 13 and 15. This makes it possible to use the dampers 13 and 15 effectively, and offers the advantage of performing a swinging movement stopping operation effectively in conformity with the weight of the particular container.

In the embodiment shown and described hereinabove, two oil dampers are used as damping 13, 15 means. It is to be understood, however, that the invention is not limited to this type of damping means, and that means comprising piston-cylinders and a restrictor, means for electrically absorbing energy, means utilizing a frictional force, etc. can be used as damping means in the invention.

Instead of using the beam 11, the sheave means 27 and 29 may be pivotally supported by the trolley 1 through a link or lever.

Figure 4:
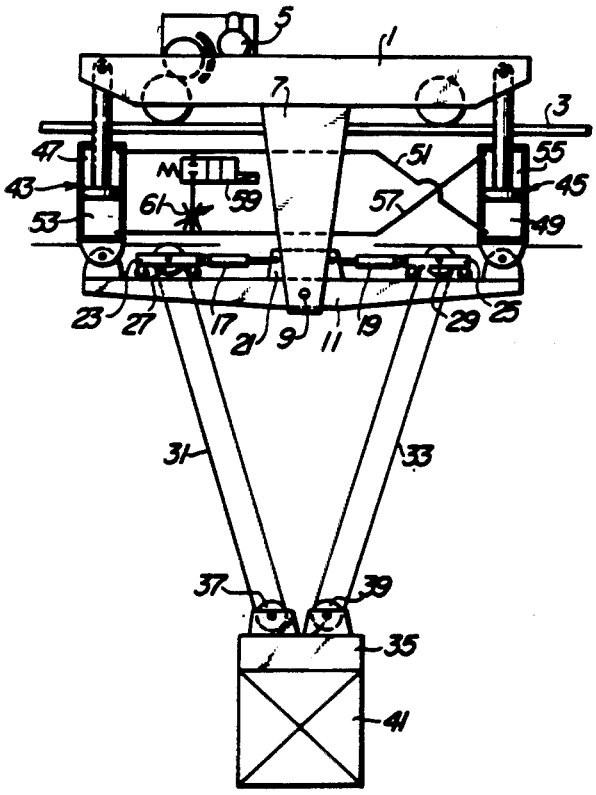
FIG. 4 is a schematic view of a modification of the embodiment of the invention.

FIG. 4 shows a modification of the embodiment of the invention shown in FIG. 1 and FIG. 2, in which piston-cylinder assemblies and a restrictor are used as damping means in place of the oil dampers 13 and 15. In FIG. 4, the beam 11 pivotally supported by the trolley 1 is connected at its left end through a hydraulic piston-cylinder assembly 43 and at its right end through a hydraulic piston-cylinder assembly 45 to the trolley 1. An upper cylinder chamber 47 of the piston-cylinder assembly 43 communicates with a lower cylinder chamber 49 of the piston-cylinder assembly 45 through a conduit 51, while a lower cylinder chamber 53 of the piston-cylinder assembly 43 communicates with an upper cylinder chamber 55 of the piston-cylinder assembly 45 through a conduit 57. A series circuit comprising a normally closed electromagnetic valve 59 and a variable restrictor 61 connects the conduits 57 and 51 together.

In the aforementioned construction, it is only after the normally closed electromagnetic valve 59 is opened following the deceleration of the trolley 1 from its normal traveling speed to a predetermined lower speed that the fluid in the cylinder chambers 47, 49, 53 and 55 is brought to a condition in which it can flow. Thus the beam 11 can move in pivotal motion about the pin 9.

When the spreader 35 and container 41 move in swinging motion, the beam 11 moves in pivotal motion about the pin 9 in synchronism with the swinging motion of the spreader and container. This causes the fluid in the cylinder chambers 47, 49, 53 and 55 to flow, through the variable restrictor 61 and electromagnetic valve 59, from one chamber to another. Thus a suitable resistance which is determined by the amount of restriction of the variable restrictor 61 is offered to the flows of the fluid, with the result that the free pivotal movement of the beam 11 is suppressed by the force exerted by the suitable resistance. If the free pivotal movement of the beam 11 is suppressed in this way, the pendulum movement of the spreader 45 and container 41 will be damped and they will finally stop their pendulum movement.

One of the advantages offered by the swinging movement stopping device provided with the energy damping mechanism shown in FIG. 4 is that it is possible to obtain suitable energy damping characteristics in conformity with different swinging conditions. Another advantage is that, by operating the electromagnetic valve 59, it is possible to freely select the direction of flow of the fluid in the cylinder chambers 47, 49, 53 and 55 or to stop its flow. For example, by closing the electromagnetic valve 59, it is possible to render the piston-cylinder assemblies 43 and 45 inoperative, so that the beam 11 can be kept in a position in which it is prevented from moving in pivotal motion or the beam can be locked before the need arises to stop the swinging motion of the spreader 35 and container 41. The electromagnetic valve 59 is opened when the trolley 1 has been decelerated to a suitable speed after approaching the destination, thereby unlocking the beam 11 and bringing it to a position in which it can move in pivotal motion. By this arrangement, it is possible to minimize the amplitude of a first swinging movement and damp the swinging movement more quickly than otherwise.

Figure 5:
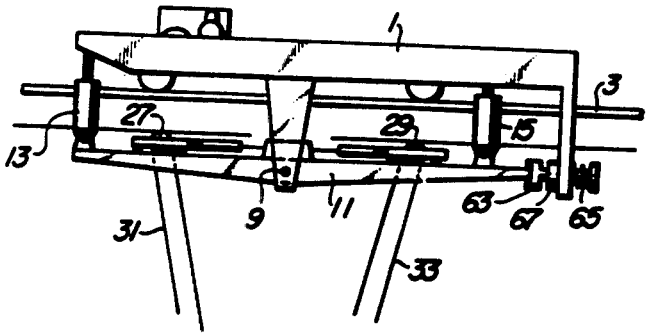
FIG. 5 is a schematic view of another modification of the embodiment of the invention.

FIG. 5 shows another modification of the embodiment in which different means is used for selectively rendering the beam 11 pivotable or non-pivotable. The construction shown in FIG. 5 is a mechanical locking mechanism in which one end of the beam 11 is immovably held in place by a stopper 63 which is bifurcated in cross-section at its end to hold the end of the beam 11 by its forked end. The stopper 63 is mounted on the trolley 1 for free horizontal sliding motion through a return spring 65. An electromagnetic oil 67 for locking the sliding movement of the stopper 63 is mounted between the trolley 1 and the stopper 63. By supplying a signal to the electromagnetic coil 67, it is possible to cause the stopper 63 to move rightwardly in sliding motion in FIG. 5 by the biasing force of the return spring 65, so that the stopper 63 is moved out of engagement with the beam 11.

Thus the beam 11 is brought to a position in which it can move in pivotal motion.

By using the mechanical locking mechanism shown in FIG. 5; it is possible to selectively move the beam 11 between pivotal and non-pivotal positions or between unlocked and locked positions, even if the electromagnetic valve 59 shown in FIG. 4 is not used and even if the energy damping means comprises the oil dampers 13 and 15 shown in FIG. 1.

Experiments were conducted on the timing of switching the beam between locked and unlocked positions. The results show that excellent swinging movement stopping effect can be achieved if the beam 11 is unlocked or brought to a pivotable position at the time the trolley 1 is decelerated such that its speed is reduced below 50% of its original speed following the application of the brake.

Figure 8:
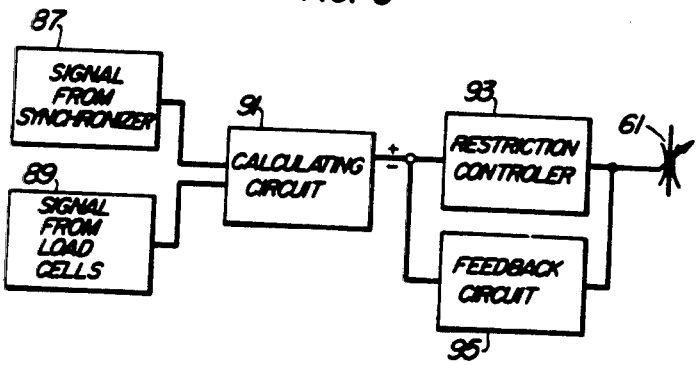
FIG. 8 is a block diagram for effecting control of the variable restrictor.

Switching of the beam 11 between its locked and unlocked positions may be performed manually. However, the end can be attained automatically by using an electric circuit in which a trolley speed detector is connected through a signal transmitting means to either the electromagnetic valve 59 (see FIG. 8) or the electromagnetic coil 67.

With reference to the energy damping mechanism shown in FIG. 4, the amount of restriction of the variable restrictor 61 may vary depending on the weight of the container 41 or the height to which the container 41 is lifted. This enables suitable energy damping characteristics to be obtained in conformity with swinging conditions. This mechanism will be described with reference to FIGS. 6, 7 and 8.

Figure 6:
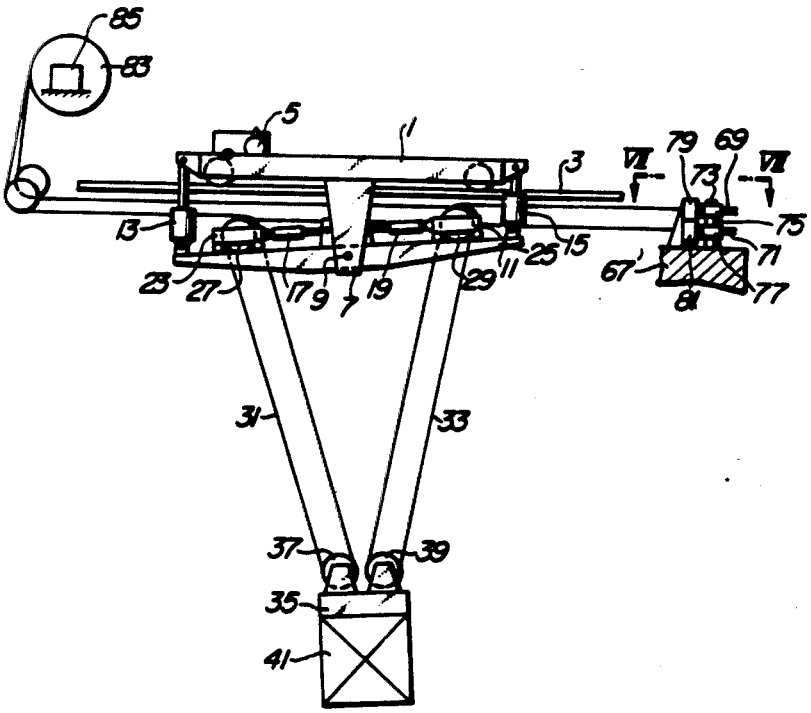
FIG. 6 is a schematic view of still another embodiment.
Figure 7:
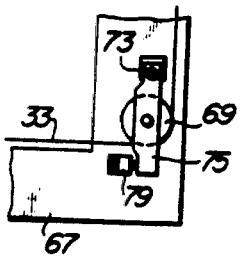
FIG. 7 is a view of a portion of the device shown in FIG. 6 as seen in the direction of arrows VII—VII.

In FIGS. 6 and 7, the overhead girder 67' on which the trolley 1 travels has mounted at its forward end sheaves 69 and 71 which guide the ropes 33 and 31 respectively at one end thereof and which are supported by beams 75 and 77 respectively adapted to move in horizontal pivotal motion about a pin 73. The beams 75 and 77 are in engagement at their free ends with load cells 79 and 81 respectively which are secured to the overhead girder 67. By this arrangement, the weight of the container 41 transmitted through the ropes 31 and 33 causes the free ends of the beams 75 and 77 respectively to move in horizontal pivotal movement and to apply pressure to the load cells 79 and 81. In this way, the weight of the container 41 can be detected by the load cells 79 and 81.

Meanwhile the ropes 31 and 33 are wound at the other end on a hoisting drum 83 and secured thereto. The hoisting drum 83 is mounted on a rotary shaft which is coupled to a synchronizer 85 so as to detect the height at which the container 41 is lifted as the hoisting drum 83 is rotated.

By this arrangement, it is possible to quickly and positively change the amount of restriction of the variable restrictor 61 to a suitable level even if there arises a change in the weight of the container 41 or the height to which the container 41 is lifted.

The operation of changing the amount of restriction of the variable restrictor 61 to a suitable level can be performed manually. However, by processing the aforementioned detected values by a system shown in a block diagram in FIG. 8, it is possible to automatically set the amount of restriction of the variable restrictor to a suitable level. Processing of the detected values by the system of FIG. 8 will be explained briefly. A value 87 detected by the synchronizer 85 and a value 89 detected by the load cells 79 and 81 are supplied to a circuit 91 which calculates a maximum amount of restriction. The output of the circuit 91 is supplied to a restriction controller 93 which produces a signal. Based on the signal produced by the controller 93, the amount of restriction of the variable restrictor 61 is set at a level which is commensurate with the detected values 87 and 89. The reference numeral 95 designates a feedback circuit which interconnects input and output sides of the restriction controller 93.

By the use of the mechanism described hereinabove, it is possible to automatically vary the amount of restriction of the variable restrictor 61 to an optimum level in conformity with a change in the weight of the container 41 or the height to which the container 41 is lifted, thereby enabling energy damping characteristics to be more positively and quickly obtained in accordance with the swinging movement of the container 41. This makes it possible to very quickly bring about cessation of the swinging movement of the container 41, in spite of the fact that there are changes in conditions under which the swinging movement of the container 41 takes place, e.g. the weight of the container 41 and the height to which the container is lifted.

We claim:

1. A device for stopping a swinging movement of a load hung by a crane having an overhead girder, the device comprising:

a trolley adapted to be mounted on the overhead girder of the crane and capable of traveling on and along the overhead girder;

a beam pivotally supported substantially at a longitudinal center thereof to said trolley so as to enable said beam to pivot about a pivot axis substantially in a vertical plane;

at least one pair of carriage means supported on said beam and disposed at opposite sides of and spaced from the pivot axis;

adjusting means for moving the carriage means toward and away from each other to adjust a distance between said at least one pair of carriage means;

sheave means mounted on each of said carriage means;

a first rope means trained over and depending from said sheave means on one of said carriage means;

a second rope means trained over and depending from said sheave means on the other of said carriage means;

a suspension member connected to lower ends of said rope means;

damping means mounted between the trolley and the beam for damping the pivoting movement of the beam in the vertical plane; and means for controlling an amount of damping to be effected in dependence upon at least a weight of the load.

2. A device as claimed in claim 1, wherein a distance between a center of said sheave means on said one carriage means and a center of said sheave means on the other of said carriage means is greater than a horizontal component of a distance between positions at which said rope means are connected to said suspension member.

3. A device as claimed in claim 1, wherein said damping means comprises at least one cylinder, a piston slidable in said cylinder to divide a space in said cylinder into two chambers, conduit means for communicating said two chambers with each other, and a restriction means mounted in said conduit means for restricting the flow of a fluid, said cylinder being connected to one of said trolley and said pivotal beam, and said piston being connected to the other of said pivotal beam and said trolley.

4. A device as claimed in claim 3, wherein said restriction means is a variable restrictor.

5. A device as claimed in claim 4, further comprising load measuring means located adjacent one end of each of said ropes, means for winding the other end of each of said ropes thereon, and means coupled to said rope winding means for detecting the lengths of portions of said ropes depending from said trolley.

6. A device as claimed in claim 3, further comprising locking means for locking the pivotal movement of said pivotal beam, said locking means comprising a valve means connected in series with said restriction means in said conduit means.

7. A device as claimed in claim 3, wherein said valve means comprises an electromagnetic valve.

8. A device as claimed in claim 1, further comprising locking means interposed between said trolley and said pivotal beam for locking the pivotal movement of said pivotal beam.

9. A device as claimed in claim 8, wherein said locking means comprises means for holding one end of said pivotal beam.

10. A device as claimed in claim 1, further comprising a pair of sheaves mounted on said suspension member, said ropes being trained over said pair of sheaves on said suspension member, respectively.

11. A device for stopping a swinging movement of a load hung by a crane having an overhead girder, the device comprising:

a trolley adapted to be mounted on the overhead girder of the crane and capable of travelling back and forth thereon;

a pivotal member pivotally supported by said trolley;

a pair of sheave means mounted on said pivotal member;

ropes trained over said pair of sheave means and respectively depending therefrom;

a suspension member connected to lower ends of said ropes;

damping means mounted between the trolley and the member for damping the pivotal movement of the pivotal member, said damping means comprises at least one cylinder, a piston slidable in said cylinder to divide a space in said cylinder into two chambers, conduit means for communicating said two chambers with each other, and restriction means mounted in said conduit means for restricting the flow of fluid, said cylinder being connected to one of said trolley and said pivotal member, and said piston being connected to the other of said pivotal member and said trolley;

locking means for locking the pivotal movement of said pivotal member, said locking means comprising a valve means connected in series with said restriction means in said conduit means, said valve means comprising a normally closed valve; and control means for shifting said normally closed valve into an open position in response to the speed of travel of said trolley.

12. A device for stopping a swinging movement of a load hung by a crane having an overhead girder, the device comprising:

a trolley adapted to be mounted on the overhead girder of the crane and capable of traveling back and forth thereon;

a pivotal member pivotally supported by said trolley;

a pair of sheave means mounted on said pivotal member;

ropes trained over said pair of sheave means and depending therefrom, respectively;

a suspension member connected to lower ends of said ropes;

damping means located between the trolley and the pivotal member for damping the pivotal movement of the pivotal member; and locking means interposed between said trolley and said pivotal member for locking the pivotal movement of said pivotal member, said locking means comprises means for holding one end of said pivotal member, said holding means comprises a stopper slidably mounted on said trolley, said stopper having an end portion disposed adjacent said pivotal member and complimentary shaped to said one end of the pivotal member.

13. A device as claimed in claim 12, wherein said holding means further comprises a spring urging said stopper in one direction, and a locking member for locking the stopper to prevent the same from moving in said one direction due to the biasing force of said spring.

14. A device as claimed in claim 13, wherein said locking member is an electromagnetic coil.

15. A device as claimed in claim 13, wherein said locking member is operative in response to the speed of traveling of said trolley to unlock the stopper for releasing the engagement of the stopper with said pivotal member.

16. A device for stopping a swinging movement of a load hung by a crane having an overhead girder, the device comprising:

a trolley adapted to be mounted on the overhead girder of the crane and capable of traveling back and forth thereon;

a pivotal member pivotally supported by said trolley;

a pair of sheave means mounted on said pivotal member;

ropes trained over said pair of sheave means and depending therefrom, respectively;

a, suspension member connected to lower ends of said ropes;

damping means mounted between the trolley and the pivotal member for damping the pivotal movement of the pivotal member;

load measuring means located adjacent one end of each of said ropes;

means for winding the other end of each of said ropes thereon;

means coupled to said ropes winding means for detecting the lengths of portions of said ropes depending from said trolley; and control means for controlling the amount of damping to be effected by said damping means to damp the pivotal movement of the pivotal member on the basis of the values detected by said load measuring means and said detecting means.

17. A device for stopping a swinging movement of a load hung from cranes having a trolley mounted for traveling on a horizontal beam, the device comprising:

a pivotal member extending generally parallel to the horizontal beam;

means disposed intermediately of opposite ends of said pivotal member for mounting said pivotal member to said trolley for pivotal movement about a pivot axis extending generally parallel to and generally transversely of a longitudinal axis of the horizontal beam;

a pair of sheave means spaced apart from one another and mounted on said pivotal member with one sheave means being disposed on each side of the pivot axis;

ropes trained over said pair of sheave means and dependent therefrom, respectively;

a suspension member connected to lower ends of said ropes;

damping means interposed between said trolley and said pivotal member for damping a swing movement of said pivotal member; and means for controlling an amount of damping to be effected in dependence upon at least a weight of the load.

18. A device as claimed in claim 17, further comprising:

a pair of carriages mounted on said pivotal member with one carriage being disposed on each side of said pivot axis, one of said pair of sheave means being mounted on one of said pair of carriages, and the other sheave means being mounted on the other carriage; and adjusting means for moving said pair of carriages toward and away from one another to adjust a distance between said pair of carriages.

19. A device as claimed in claim 18, wherein a distance between a center of said sheave means on one of said carriages and a center of the sheave means on the other of said carriages is greater than a horizontal component of a distance between connecting points of the ropes to said suspension member.

20. A device as claimed in claim 18, wherein a distance between a center of one of said pair of sheave means and a center of the other sheave means is greater than a horizontal component of a distance between connecting points of said ropes to said suspension member.

21. A device for stopping the swinging movement of a load hung from cranes having a trolley mounted for traveling on a horizontal beam, the device comprising:

a pivotal member formed as a beam extending generally parallel to the horizontal beam;

means disposed intermediately of opposite ends of said pivotal member for mounting said pivotal member to said trolley for pivotal movement about a pivot axis extending generally parallel to and generally transversely of a longitudinal axis of the horizontal beam;

a pair of sheave means spaced apart from one another and mounted on said pivotal member with one sheave means being disposed on each side of the pivot axis;

a pair of carriages mounted on said pivotal member with one carriage being disposed on each side of said pivot axis, one of said pair of sheave means being mounted on one of said pair of carriages, and the other sheave means being mounted on the outer carriage;

a first rope trained over and depending from the sheave means on one of said carriages and a second rope trained over and depending from the sheave means on the other of said carriages;

a suspension member connected to lower ends of said ropes;

damping means interposed between said trolley and said pivotal member for damping a pivotal movement of said pivotal member;

means for controlling an amount of damping to be effected in dependence upon at least a weight of the load; and drive means for moving said carriages toward and away from said pivot axis.

22. A device for stopping a swinging movement of a load hung from cranes having a trolley mounted for traveling on a horizontal beam, the device comprising:

a pivotal member pivotally supported by said trolley, a pair of sheave means mounted on said pivotal member, ropes trained over said pair of sheave means and respectively depending therefrom, a suspension member connected to lower ends of said ropes, damping means mounted between the trolley and the pivotal member for damping a pivotal movement of the pivotal member, and means connected to said damping means for controlling a damping effect of the damping means in dependence upon at least one of the weight of the load and speed of the trolley.

23. A device according to claim 22, wherein said damping means includes a cylinder connected to one of said trolley and said pivotal member, a piston connected to the other of said trolley and said pivotal member so as to divide a space within said cylinder into two chambers, a line means for connecting said two chambers with each other and wherein said means for controlling the damping effect are disposed in said line means and are adapted to control a flow rate of fluid between the two chambers and a blocking of fluid flow between the two chambers.

24. A device according to claim 22, wherein said damping means includes at least one pair of piston-cylinder assemblies, one of said piston-cylinder assemblies being disposed between each end of said pivotal member and said trolley, each of said piston-cylinder assemblies comprising a cylinder connected to one of said pivotal member and said trolley and a piston connected to the other of said pivotal member and said trolley, said pistons being disposed in the respective cylinders so as to divide a space within the cylinders into upper and lower chambers, a first line means for connecting the lower chamber in one of the piston-cylinder assemblies to the upper chamber in the other piston-cylinder assembly, a second line means for connecting the upper chamber in said one piston-cylinder assembly and the lower chamber in the other piston-cylinder assembly, a communicating line means for communicating said first and second line means with each other, and wherein said means for controlling the damping effect are disposed in the communicating line means and are adapted to control the flow rate of fluid and to block the flow rate of fluid through the communicating line means.

25. A device according to claim 24, wherein said means for controlling the flow rate and blocking of the flow rate includes a throttle valve and an opening and closing valve provided in series in said communicating line means.

26. A device according to claim 22, wherein said means for controlling the damping effect is adapted to lock and unlock the damping means to thereby control the damping effect.

* * * * *